United States Patent [19]

Noe

[11] Patent Number: 4,760,268

[45] Date of Patent: Jul. 26, 1988

[54] CONTAINER FOR LOW OR MEDIUM ACTIVITY RADIOACTIVE WASTE

[75] Inventor: Claude Noe, Venelles, France

[73] Assignee: Commissariat a l'Energie Atomique, Paris, France

[21] Appl. No.: 877,780

[22] Filed: Jun. 24, 1986

[30] Foreign Application Priority Data

Jul. 9, 1985 [FR] France ..... 85 10496

[51] Int. Cl.[4] ..... G21F 5/00

[52] U.S. Cl. ..... 250/506.1; 252/628; 252/633

[58] Field of Search ..... 250/506.1; 252/633, 252/628; 220/66, 326

[56] References Cited

U.S. PATENT DOCUMENTS

| | | | |
|---|---|---|---|
| 3,814,278 | 6/1974 | Beierle | 220/326 |
| 4,117,926 | 10/1978 | Turner et al. | 220/66 |
| 4,582,638 | 4/1986 | Homer et al. | 250/506.1 |

FOREIGN PATENT DOCUMENTS

| | | | |
|---|---|---|---|
| 518082 | 2/1931 | Fed. Rep. of Germany . | |
| 911704 | 5/1954 | Fed. Rep. of Germany . | |
| 2350279 | 12/1977 | France . | |
| 2473213 | 7/1981 | France | 252/628 |

*Primary Examiner*—Craig E. Church
*Assistant Examiner*—Jack I. Berman
*Attorney, Agent, or Firm*—James E. Nilles

[57] ABSTRACT

In a container comprising a drum and a cover, the cover is locked on to the drum by providing, on the cover periphery, a series of vertical tongues inclined towards the outside in such a way that their end can be located beneath a shoulder of the drum. The part of the cover which bears on the upper edge of the drum is elastically deformable so as to facilitate latching in place. An injection shaft formed in the cover makes it possible to inject into the drum a material for covering the radioactive waste contained therein. This configuration permits an automation of the conditioning and storage of the waste.

6 Claims, 2 Drawing Sheets

CONTAINER FOR LOW OR MEDIUM ACTIVITY RADIOACTIVE WASTE

BACKGROUND OF THE INVENTION

The present invention relates to a container for the conditioning of medium or low activity radioactive waste. For facilitating the storage thereof, low and medium activity radioactive waste is normally conditioned or stored in containers in the form of drums sealed by covers. After being placed in the drums, the waste is coated with a bituminous mixture injected through an opening made in the cover.

In the case of low activity waste, the containers are normally locked by bolting the cover onto the drum. In the case of medium activity waste, it is not possible for personnel to bolt down the cover, so that the container is locked through the setting of the bituminous mixture.

In both cases, the containers takes a long time to lock making the presently used container locking means completely unsuitable for the automation of the operations of conditioning medium and low activity radioactive waste.

However, as a result of the increase in the number of nuclear power stations throughout the world, there has been a considerable rise in the amount of waste. It is therefore highly desirable to have an easily remotely manipulatable and lockable container, so that it is possible to achieve a sufficiently high speed to allow the conditioning and coating of the waste by an automatic line.

SUMMARY OF THE INVENTION

The present invention therefore specifically relates to a container for medium or low activity radioactive waste, comprising a drum equipped with an open end and a cover able to seal said end, the open end of the drum having a shoulder turned towards the inside thereof, said cover carrying at least three circumferentially spaced tongues, whereof the end is turned so as to be able to bear against said shoulder when the cover bears on the edge of the open end of the drum, wherein the cover comprises two parallel plates interconnected by radial baffle members defining between them angular sectors and an outer cylindrical ferrule fixed to the baffle members between the two plates, a first of said plates having an elastically deformable peripheral portion able to bear on the edge of the open end, said outer cylindrical ferrule having a diameter smaller than the internal diameter of the shoulder and carrying said tongues and wherein the cover also comprises a central ferrule defining an injection shaft traversing the first plate and communicating by openings with part of the angular sectors, said sectors communicating with one another by windows formed in the baffle members and with the interior of the drum by at least one opening formed on the peripherary of the other plate, said first plate being provided in the vicinity of the injection shaft with vents issuing into the angular sectors not communicating with the injection shaft.

The automation of the conditioning can be improved by having a means for detecting the presence of the drum filling material level with the vents.

In order to guarantee the sealing of the locking of the container, the elastically deformable part of the cover can carry a gasket able to bear on the edge of the open end of the drum.

BRIEF DESCRIPTION OF THE DRAWINGS

The invention is described in greater detail hereinafter relative to non-limitative embodiments and the attached drawings, wherein show.

DETAILED DESCRIPTION OF THE INVENTION

Figure 1:
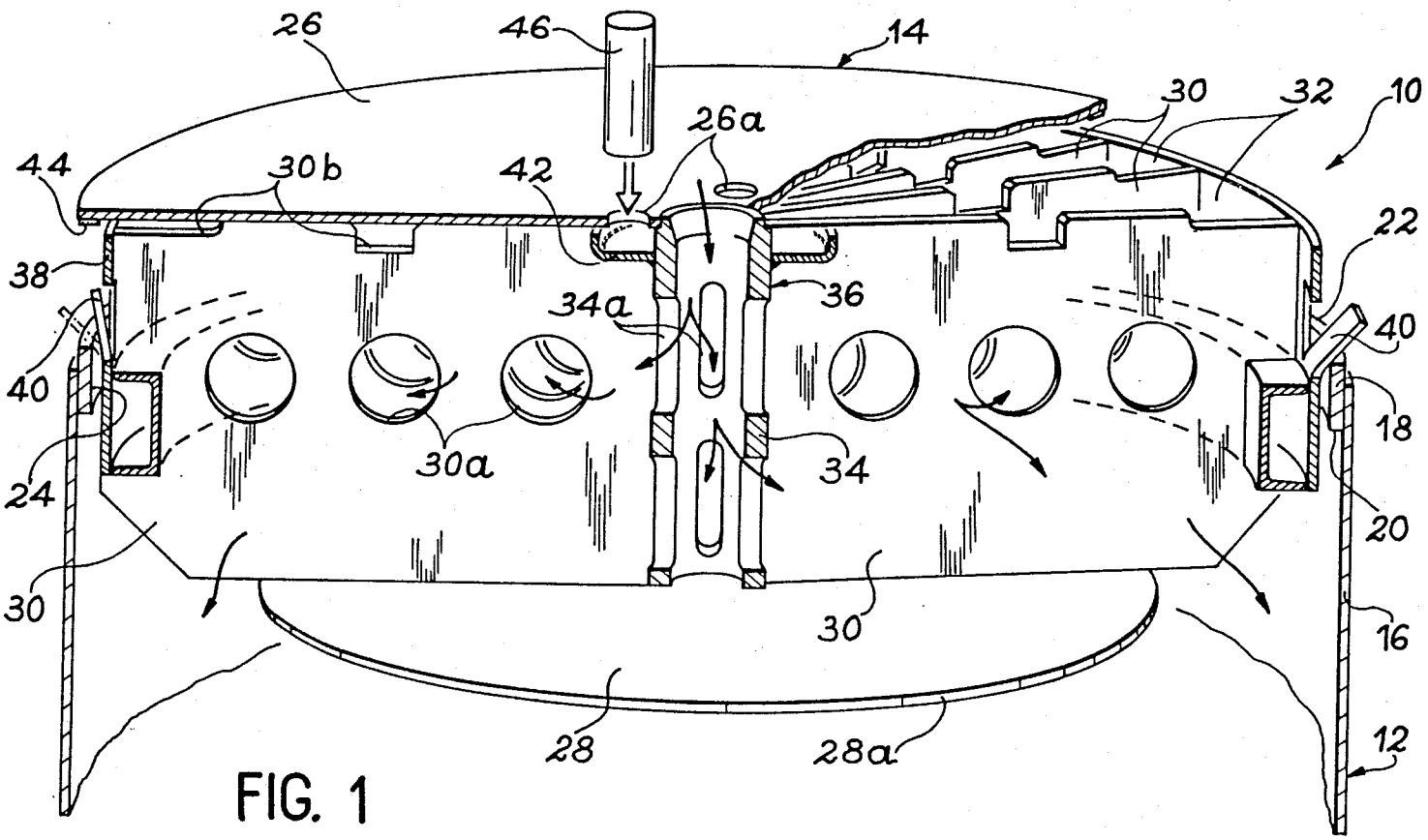
FIG. 1—An exploded perspective view showing the upper open end of a radioactive waste conditioning drum and the plug sealing said drum for forming a container according to the invention.

FIG. 1 shows the upper part of a medium or low activity radioactive waste storage container produced according to the invention. This container is designated in general terms by reference numeral 10 and comprises a cylindrical drum 12 and a cover 14. Cylindrical drum 12 comprises a cylindrical wall 16 sealed at its lower end by a not shown base and whose upper open end can be tightly sealed by cover 14.

According to the invention, a circumferential retaining ring 18 is welded on to the inner face of the cylindrical wall 16 at the upper end thereof. The horizontal lower face of the retaining ring 18 forms a shoulder 20 turned towards the inside of the drum, whereas the horizontal upper face 22 of the retaining ring 18 forms the upper edge of the drum. The cylindrical inner face 24 of retaining ring 18 defines the opening in which is received cover 14.

In the preferred embodiment of the invention shown in FIG. 1, cover 14 comprises an upper horizontal plate 26 and a lower horizontal plate 28, both in the form of disks. Plates 26 and 28 are respectively welded onto the upper and lower edges of a series of radial baffle members 30 regularly spaced around the axis of cover 14. These baffle members 30 define between them angular sectors 32.

Plates 26 and 28 are also connected by a central cylindrical ferrule 34 disposed in accordance with the axis of cover 14. Ferrule 34 defines an injection shaft 36 for a drum filling material. This injection shaft 36 traverses the upper plate 26 so as to issue above cover 14. It is sealed at its lower end by plate 28. The central ferrule 34 is welded both to the plates 26 and 28 and to the radial baffle members 30.

Cover 14 also has an outer cylindrical ferrule 38 welded to the outer peripheral edge of the radial baffle members 30. The external diameter of ferrule 38 is slightly smaller than the diameter of the inner face 24 of retaining ring 18. The diameter of the upper plate 26 is greater than the diameter of face 24 of the retaining ring, so that the peripheral portion of plate 26 can bear by its lower face on the upper edge 22 of ring 18.

In order to ensure a tight seal when plate 26 bears on edge 22 of the retaining ring, an annular gasket 44 can be mounted on the lower face of plate 26 to tightly bear against edge 22.

According to an essential feature of the invention, regularly distributed vertical tongues 40 are cut into the metal sheet constituting the outer cylindrical ferrule 38. These tongues 40 are inclined radially towards the outside with respect to the ferrule 38 and their end is turned towards the upper plate 26. More specifically, the end of each of the tongues 40 is located approximately at a uniform distance from the upper plate 26, said distance being slightly less than the distance separating shoulder 20 from the upper edge 22 of retaining ring 18.

According to another essential feature of the invention, the peripheral portion of upper plate 26 is not welded to the radial baffle members 30, so that peripheral portion is elastically deformable.

Figure 2:
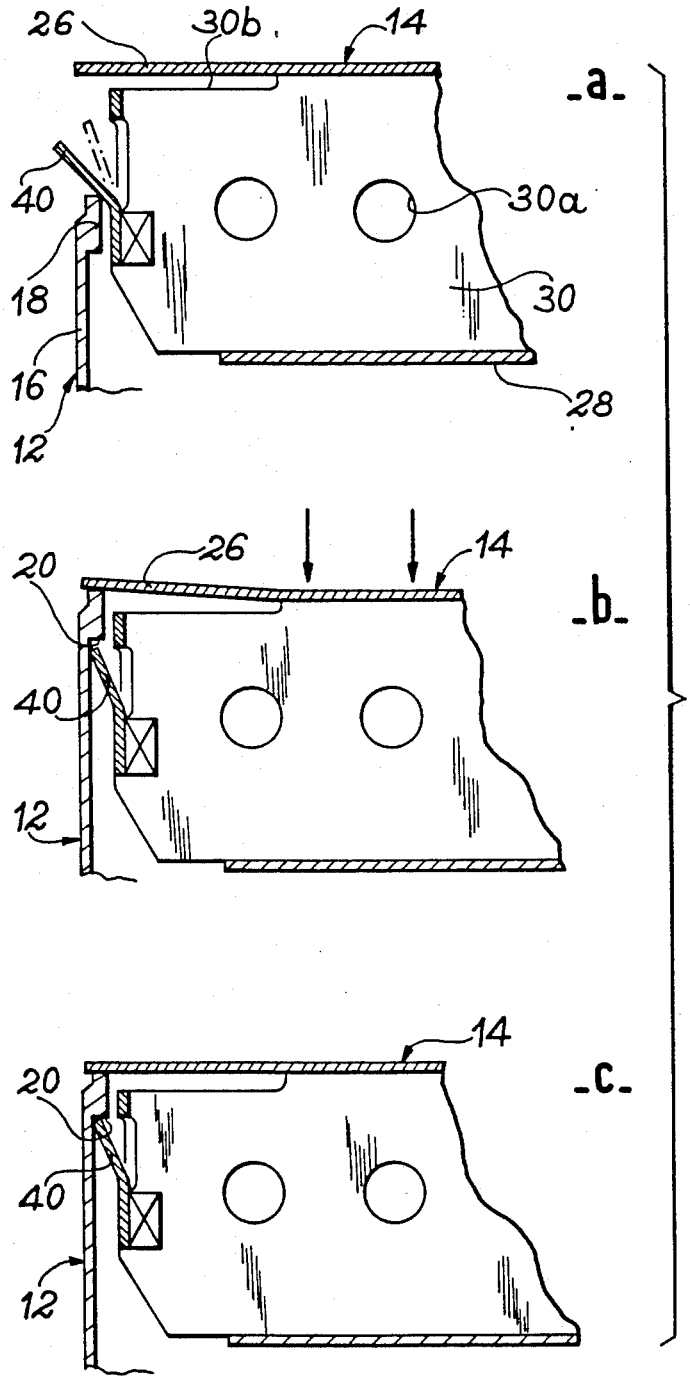
FIGS. 2*a* to 2*c*—Part longitudinal sectional, diagrammatic views illustrating three stages of the locking of the cover onto the drum.

Before the cover 14 of the container according to the invention is locked onto drum 12, it is placed on the same as illustrated in FIGS. 1 and 2*a*. To ensure that the cover remains in the wait position and does not sink by gravity on to the drum, a certain number of tongues 40 (e.g. 3 or 4) regularly spaced around the cover are inclined by approximately 45° towards the outside, whereas the angle of inclination of the other tongues is less, e.g. approximately 10°.

This cover wait position can be used in an automatic conditioning or storage line for bringing the containers up to a filling station. At the latter a handling device, e.g. equipped with a suction cup gripping system removes cover 26. The waste to be conditioned is then compacted in drum 12.

The handling device then places the cover back into position and locks it on the drum by simply driving it in, exerting on cover 14 an adequate pressure to ensure that the ends of the tongues 40 are positioned below shoulder 20. As illustrated by FIG. 2*b*, said locking is made possible due to the elasticity of the tongues 40 and that of the peripheral portion of the upper plate 26 of the cover.

When the pressure with which the plug 14 is driven on to the drum is relaxed, as illustrated in FIG. 2*c*, the elasticity of the peripheral portion of the upper plate 26 of the plug brings the end of the tongues 40 into bearing engagement with shoulder 20. It should be noted that the thus obtained connection between cover 14 and drum 12 is adequate to ensure the handling of the container by the same suction cup handling device as that used previously for ensuring the handling of the cover alone.

When the cover has been locked onto the drum in the manner described hereinbefore, the bituminous mixture is injected into the drum and cover to bring about the coating of the radioactive waste. For this purpose, cover 14 has a particular structure which will now be described in greater detail relative to FIG. 1.

The bituminous mixture is injected at the upper end of shaft 36 and then enters certain of the angular sectors 32 defined by the baffle members 30 through openings 34*a* made in the central ferrule 34. The material then flows within the drum beyond the peripheral edge 28*a* of the lower plate 28, whose diameter is significantly less than the diameter of the outer ferrule 38. This peripheral edge 28*a* of plate 28 thus defines an annular opening by means of which the filling material is admitted into the drum 12.

When drum filling is completed, the bituminous mixture starts to fill the angular sectors 32 communicating with the shaft 36 by opening 34*a*. The other sectors 32 are also filled by windows 30*a* formed in the radial baffle members 30.

During the filling, the air or gas initially contained in the drum and cover is evacuated by vents 26*a* formed in plate 26 in the vicinity of inner ferrule 34. These vents issue into angular sectors 32 not communicating with the injection shaft 36 by openings 34*a*. In order that the air or gas may be evacuated from the sectors 32 communicating with the shaft 36 when the bituminous mixture arrives at a level above that of windows 30*a*, notches 30*b* are also formed on the upper part of the baffle members 30.

Preferably a cup 42 is welded on to the central ferrule 34 in the vicinity of upper plate 26 and below vents 26*a*. A detection device 46, such as an optical probe placed above at least one of the vents 26*a* then makes it possible to automatically control the stopping of the injection of the bituminous material as soon as it starts to fill cup 42.

As a result of the structure of the cover according to the invention, the container can be carried away with the aid of the suction cup gripping system as soon as the filling operation is ended and without waiting for the bituminous mixture to solidify, which makes it possible to ensure that the automatic conditioning line operates at a high speed.

Obviously the invention is not limited to the embodiment described in exemplified manner hereinbefore and in fact covers all variants thereof. In particular, the shoulder 20 on which bears the ends of tongues 40 could be produced directly by machining the drum wall 16, if permitted by its thickness, or by the shaping or stamping of said wall. Moreover, even when shoulder 20 is formed on a joined retaining ring 18, as described hereinbefore, the upper edge 22 on which bears the upper plate 26 of the cover can be directly constituted by the upper edge of the drum wall 16.

Moreover, although it is particularly advantageous to machine tongues 40 directly on ferrule 38, said tongues could also be joined to said ferrule without passing beyond the scope of the invention, Finally, it is obvious that the structure of the cover 14 described hereinbefore is not limitative, particularly with respect to the perforations making it possible to inject the bituminous mixture into the drum.

What is claimed is:

1. A container for medium or low activity radioactive waste comprising a drum which has an axis and a side wall concentric to said axis and which is open at an upper axial end thereof, and a cover for closing said open end of the drum, said container being characterized by:

A. said cover comprising an upper and a lower disc-like horizontal plate and a plurality of plate-like baffle members between said plates that connect them in spaced apart and parallel relationship, said lower plate and baffle members being receivable within the drum in a closed condition of the cover wherein said upper plate overlies the upper end of the drum all around the same, (1) said baffle members (a) extending edgewise radially and axially to cooperate in defining a plurality of radially outwardly divergent sectors, (b) having upper edge portions secured to said upper plate in radially inwardly spaced relation to the periphery thereof, (c) having lower edge portions secured to the lower plate to hold the same substantially concentric to the upper plate, and (d) being apertured to provide for communication between each said sector and its adjacent sectors, (2) said upper plate having (a) a central aperture and (b) a plurality of vent apertures which are near said central aperture and which open from certain of said sectors, and (3) said lower plate being of a shape and size to have peripheral portions spaced radially inwardly from said side wall of the drum when the cover is in closed condition, for communicating all of said sectors with the portion of the drum interior that is below the lower plate;

B. said drum having a circumferential ledge near its upper end that defines a downwardly facing shoulder which projects radially inwardly from said side wall;

C. means carried by said baffle members at their radially outer ends providing a plurality of substantially resilient tongues at circumferentially spaced intervals around the cover, each said tongue projecting obliquely radially outwardly and axially upwardly to have a free end portion which is deflected radially inwardly by said ledge as the cover is moved down to its closed condition and which lockingly engages under said shoulder when the cover reaches said condition; and D. said cover further comprising a central coaxial ferrule extending between said plates, said ferrule (1) being communicated at an upper end thereof with said central aperture in the upper plate, (2) having its lower end substantially closed by said lower plate, and (3) having outlet apertures intermediate its ends that open into sectors other than said certain sectors.

2. The container of claim 1, further characterized by: said upper plate having an elastically deformable peripheral portion capable of flexing to bear against the upper end of said drum under resilient bias all around the same.

3. The container of claim 2, further characterized by: each said baffle member having an upper edge portion which is spaced below said peripheral portion of the upper plate to leave the same free for flatwise flexing.

4. The container of claim 3, further characterized in that: each said baffle member has a notch in its upper edge, intermediate the radially inner and radially outer ends of the baffle member, to provide for communication between said sectors at a level downwardly adjacent to the upper plate.

5. The container of claim 1, further characterized by: a gasket secured to the underside of said upper plate, around the peripheral portion thereof, for sealingly engaging the upper end of the drum.

6. The container of claim 1, further characterized by: a cup-shaped receptacle coaxially secured to said ferrule and surrounding the same near said upper end thereof, said receptacle having (1) a bottom wall which is spaced a substantial distance above said lower plate and which underlies said vent apertures in the upper plate, and (2) a side wall which projects upwardly from said bottom wall all around the same, in radially outwardly spaced relation to said ferrule, and which has an upper edge that is spaced below said upper plate.

* * * * *